US005735775A

United States Patent [19]

Miasserian

[11] Patent Number: 5,735,775

[45] Date of Patent: Apr. 7, 1998

[54] PUNCHING DEVICE

[76] Inventor: Gregory G. Miasserian, 26 Beacon St., Apt. 37E, Burlington, Mass. 01803

[21] Appl. No.: 828,283

[22] Filed: Mar. 21, 1997

Related U.S. Application Data

[62] Division of Ser. No. 334,419, Nov. 4, 1994, Pat. No. 5,613,925.

[51] Int. Cl.[6] ..... A63B 69/34

[52] U.S. Cl. ..... 482/83; 482/87; 482/86

[58] Field of Search ..... 482/83–90

[56] References Cited

U.S. PATENT DOCUMENTS

| | | | |
|---|---|---|---|
| 4,564,192 | 1/1986 | Lebowitz | 482/87 |
| 4,749,184 | 6/1988 | Tobin | 482/86 |
| 5,277,679 | 1/1994 | Wells | 482/83 |
| 5,342,267 | 8/1994 | Adams et al. | 482/83 |
| 5,389,057 | 2/1995 | Zagata, Jr. | 482/83 |
| 5,509,875 | 4/1996 | Moretti | 482/83 |
| 5,613,925 | 3/1997 | Miasserian | 482/83 |
| 5,665,035 | 9/1997 | Tumminia | 482/83 |

*Primary Examiner*—Jerome Donnelly
*Attorney, Agent, or Firm*—O'Connell Law Firm

[57] ABSTRACT

A punching device comprised of a first component device and a second component device that closely simulates actual boxing by challenging a user with the combined tasks of striking at least one pad device while avoiding or preventing being struck by a rotating striking device. The first component device has an upstanding support that is mountable on a floor or to a wall with at least one pad device attached to the upstanding support. There may be six pad devices with three pad devices attached to the upstanding support in a generally horizontal row to form a top group and three pad devices attached in a generally horizontal row at a distance below the top group to form a bottom group. Each pad device has a spring extending from a back of a pad portion to the upstanding support. When struck by a punch, the pad devices compress and then spring back. The second component device is comprised of a motorized arm with a striking device such as a boxing glove attached to an end of the motorized arm. The motorized arm is attached to a motor pipe device that rotates the motorized arm at any desired speed of rotation including a random setting. The arm is capable of swinging 360 degrees into and out of proximity with the top and bottom groups of pads of the first component device. Ideally, a user of the punching device will seek to avoid being struck by the striking device as it rotates while the user is punching the at least one pad device.

14 Claims, 5 Drawing Sheets

PUNCHING DEVICE

This application is a divisional of copending application application Ser. No. 08/334,419 filed on Nov. 4, 1994 now U.S. Pat. No. 5,613,925.

FIELD OF THE INVENTION

The present invention relates generally to exercise devices. More particularly, it relates to a punching device that calls upon a user to punch at least one pad device while avoiding or preventing being struck by a rotating striking device.

BACKGROUND OF THE INVENTION

By way of background, one may note that U.S. Pat. No. 4,593,900 discloses a boxing robot which is comprised of a figure simulating a boxer which is mounted to a post. A first arm is mounted to the post for pivoting in a vertical plane. A second arm is mounted to a vertical rod mounted within the figure. A prime mover causes the rod to rotate and, as it does so, the second arm rotates in a horizontal plane. A roller is connected to the rod and periodically contacts the second arm thereby causing the arm to elevate. Gravity causes the second arm to fall when it is not contacted by the roller. The roller is so positioned to the rod that it causes the second arm to elevate when the first arm is behind the figure and allows the second arm to fall when the first arm is in front of the figure.

Furthermore, U.S. Pat. No. 4,401,303 discloses an athletic reflex machine which has a human simulative body pivotally mounted on a pedestal, human-opponent sensing means peering out of a window at the eye position and a respective gimbal-mounted pneumatically powered striker simulating each of the arms and legs. When a user (human target) is sensed within range, one or more of the strikers may lash out in the direction in which the target is sensed, regardless of whether the body exactly faces the target. A random interruption is provided to make the response less predictable.

Still further, U.S. Pat. No. 4,353,545 discloses an athletic reflex machine. The martial-arts practice apparatus includes an upright panel with a plurality of pneumatically-actuable strikers that are valve controlled to lash out toward the user and retract in simulation of weaponless combat. The sequence of actuation of the strikers is determinable by a motor-driven lobe roll with adjustable lobes or cams for actuating the striker control valves, or without this provision, manually by depression of valve actuators in any sequence desired thereby permitting a colleague of the user to engage in a contest with the user through selective actuation of the strikers. Two or more strikers can be actuated to lash out simultaneously.

Unfortunately, the prior art as exemplified above has left a real need for a punching device that challenges the user with the combined tasks of striking at least one pad device while avoiding or preventing being struck by an oncoming striking device.

SUMMARY OF THE INVENTION

Advantageously, a principal object of the present invention is the providing of a punching device which calls upon a user to strike selectively at at least one pad device while evading a rotating striking device. This and other objects of the invention will become obvious to one reading the present disclosure.

In accomplishing the aforementioned objects, the punching device of the present invention is comprised essentially of a combination of two component devices. A first component device is comprised essentially of an upstanding panel or flat board that is mountable on a floor or a wall with at least one pad device attached to the panel. There may be a multiplicity of pad devices with at least one pad device attached to the panel to form a top group and at least one pad device attached to the panel at a distance below the top group to form a bottom group. Although the number of pads may vary, one preferred embodiment includes six pads with three attached generally horizontally as the top group and three attached generally horizontally to form the bottom group. Preferably, each pad has a spring attached to the back of the pad and to the flat board. When struck by a punch, the pads compress and then spring back.

The second component device is comprised essentially of a motorized arm that has a striking device such as a boxing glove attached to an end thereof. In one embodiment, the motorized arm is attached to a motor pipe device that provides any desired speed of rotation of the arm device including a random setting. In operation, the arm swings 360 degrees into and out of proximity with the at least one pad of the first component. A user of the punching device will seek to avoid being struck by the striking device as he or she seeks to punch the at least one pad device. With these combined tasks, the punching device closely simulates actual boxing.

DETAILED DESCRIPTION OF PREFERRED EMBODIMENT(S)

Figure 1:
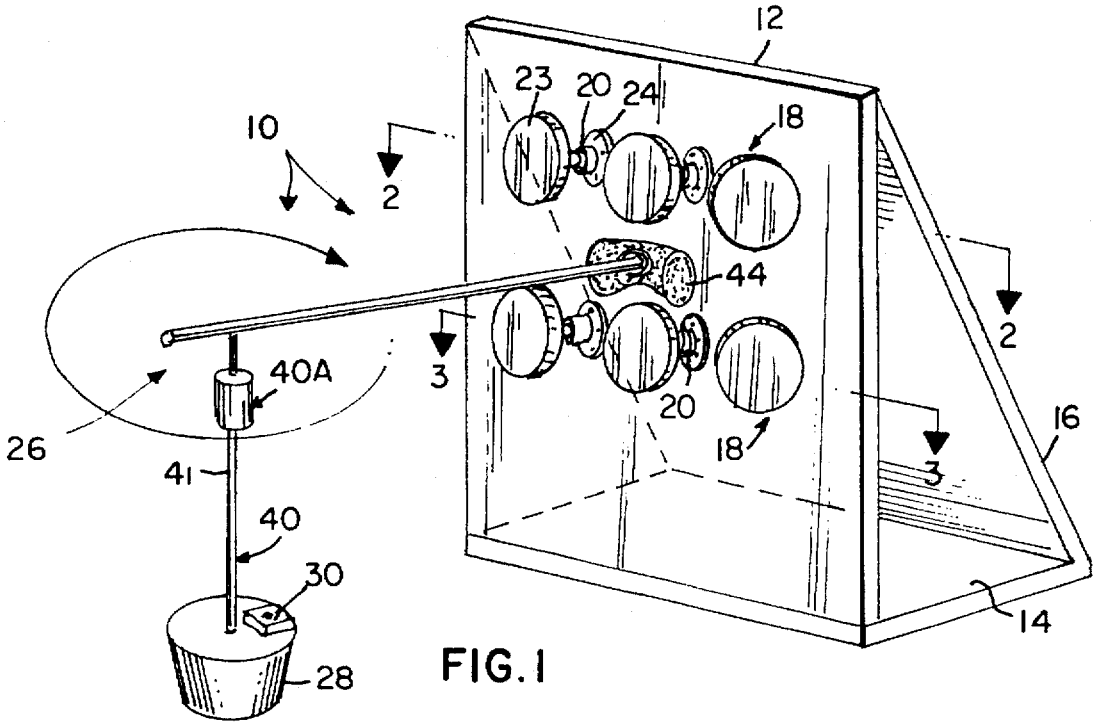
FIG. 1 is a perspective view illustrating one embodiment of a punching device embodying the principles of the present invention, showing six pad devices with three positioned horizontally as a top group and three positioned horizontally as a bottom group, and showing the motorized arm rotating.
Figure 2:
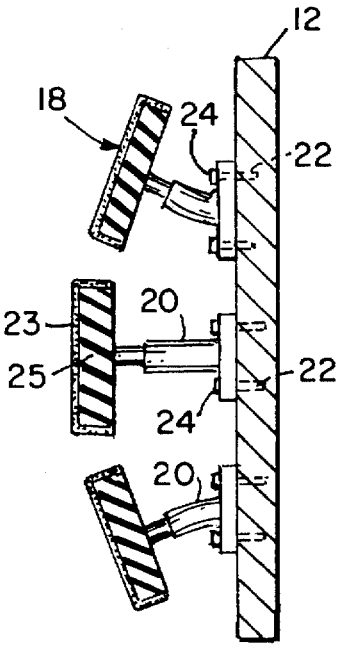
FIG. 2 is a cross-sectional view taken along the line 2—2 of FIG. 1 showing only the top group of pad devices.
Figure 3:
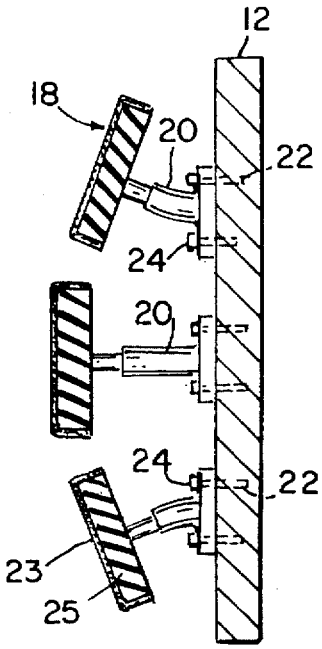
FIG. 3 is a cross-sectional view taken along the line of 3—3 of FIG. 1 showing only the bottom group of pad devices.
Figure 4:
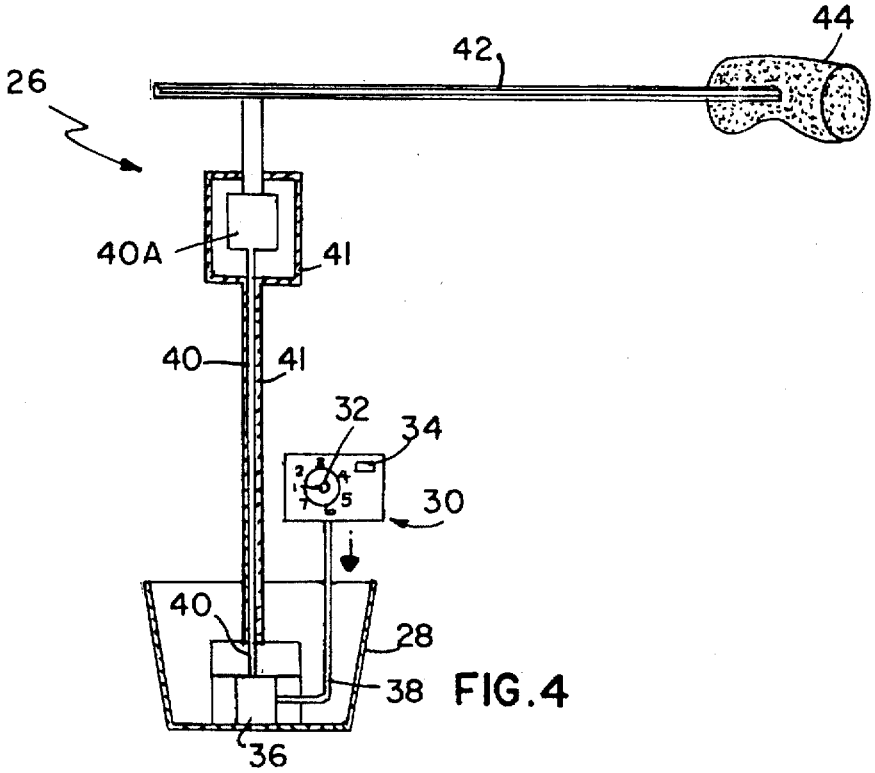
FIG. 4 is an elevational view of the motorized arm device shown in the embodiment of the invention of FIG. 1.

Referring more particularly to FIGS. 1–4, one preferred embodiment of the present invention for a punching device is indicated generally at 10. FIG. 1 shows the punching device 10 as having an upstanding support such as flat board 12 held by a bottom base board 14 extending toward the rear of the flat board 12 with diagonal support braces 16 attached to the bottom base board 14 and the upstanding flat board 12. Attached to the front of the upstanding flat board 12 are six round pad devices 18. Three pad devices 18 are attached in a generally horizontal row to form a top group of pad devices 18, and three pad devices 18 are attached in a generally horizontal row at a distance below the top group of pad devices 18 to form a bottom group of pad devices 18. Each pad device 18 has a spring attaching device 20. The spring attaching devices 20 are attached to the flat board member 12 which is attached by conventional bolt and nut members 22 and 24. The pad devices 18 are preferably formed of an outer leather covering device 23 and an inside rubber pad device 25.

Figure 5:
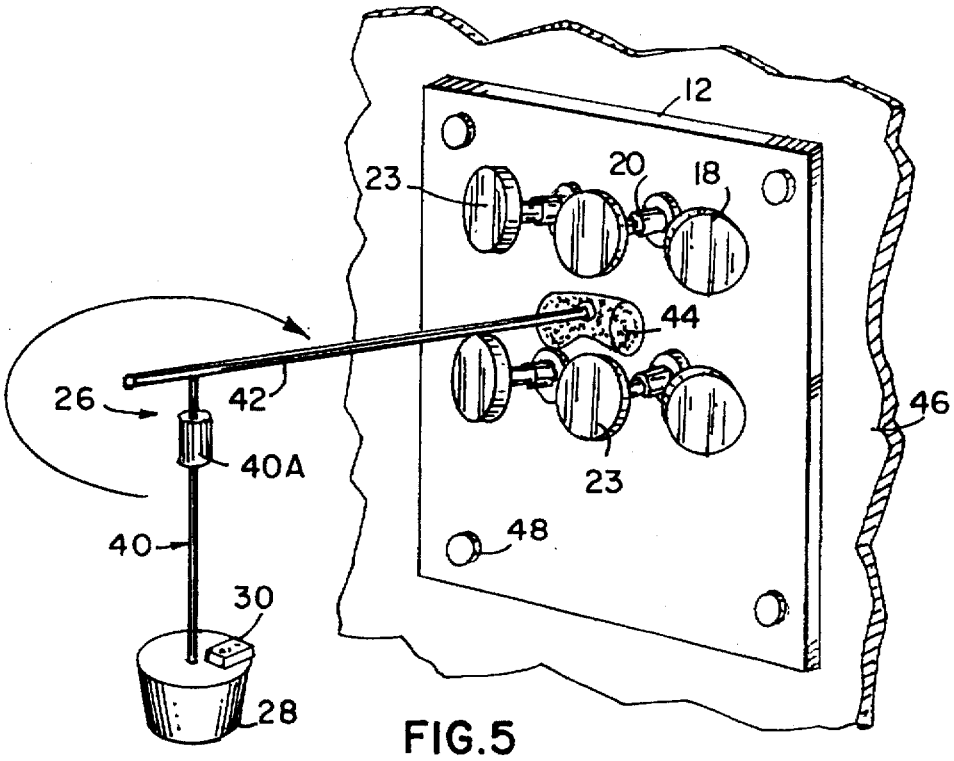
FIG. 5 is a fragmentary view of six pad devices attached to a wall.

A motorized arm device 26 of a presently-preferred embodiment is formed of a weighted stand 28 which contains an operating device 30 which contains a speed control device 32 and an on/off switch device 34. The on/off switch 34 contacts a control system device 36 which is contacted by an electrical motorized device 38 which causes the control system device 36 to rotate an inside pipe 40 and an upper portion 40A which are covered by a device 41. The upper portion 40A is attached to an arm device 42 and rotates a striking device such as a boxing glove 44 which is attached to an end of the arm device 42 as is shown in FIGS. 1, 4, 5, 6 and 7. In a most preferred embodiment, the motorized arm device 26 may include a means for alternately rotating the striking device such as boxing glove 44 in a first direction followed by a second, opposite direction. FIG. 5 shows the flat board 12 with a shorter bottom and attachable to a wall 46 by wing nuts 48.

Figure 6:
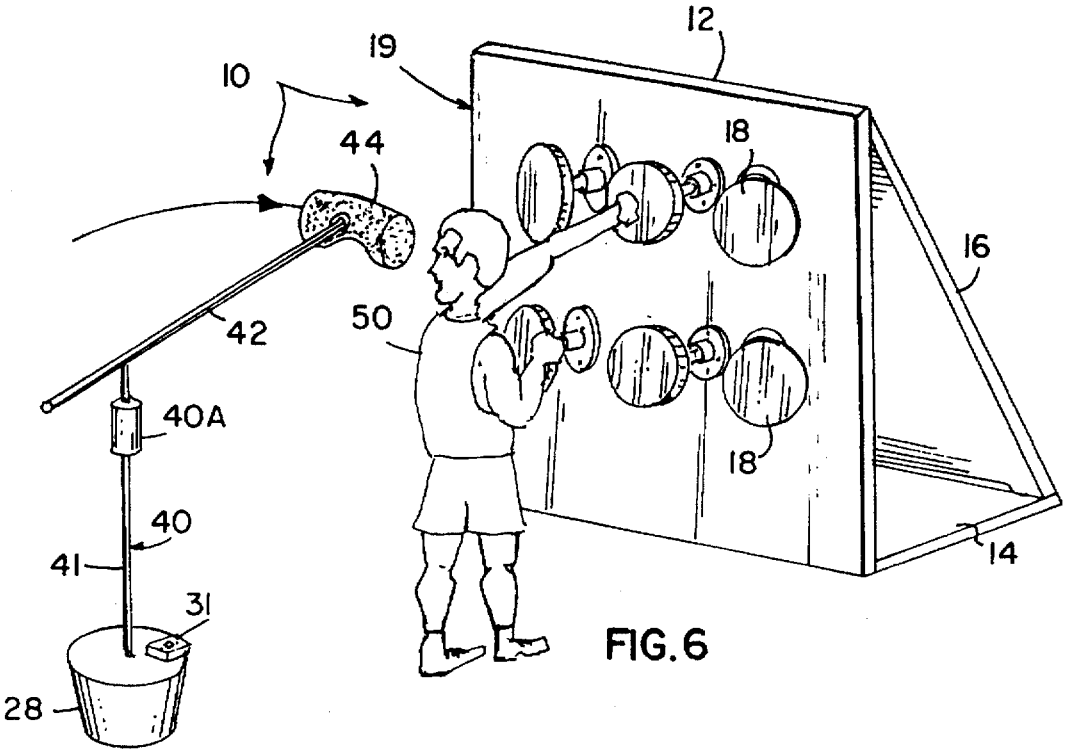
FIGS. 6 and 7 illustrate an operational example of a preferred embodiment of the punching device.
Figure 7:
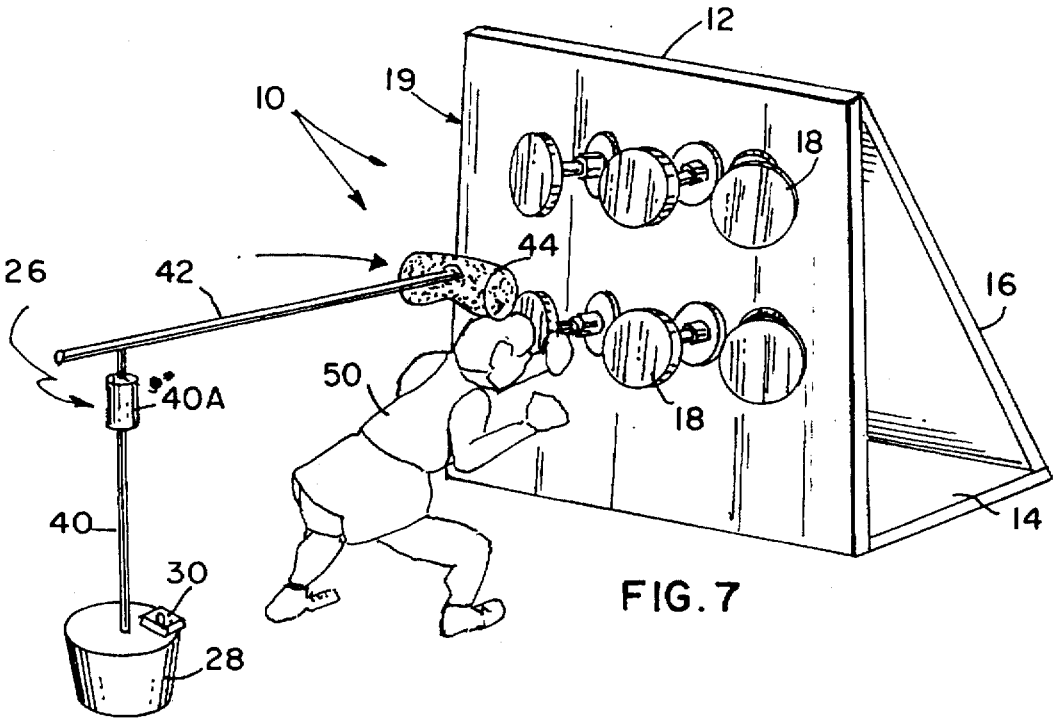

FIGS. 6 and 7 illustrate one example of how a person 50 may use the punching device of the present invention. As illustrated in FIG. 6, the person 50 punches the pad devices 18 while the arm device 42 of the motorized arm 26 rotates into and out of proximity with the area 19 between the upper pad devices 18 and the lower pad devices 18. As is illustrated in FIG. 7, the person 50 crouches down to avoid the striking device such as boxing glove 44 as it is rotated. It is to be understood further that the person 50 may punch or block the boxing glove 44 instead of crouching down to avoid it. This would stop the arm device 42 from rotating until the person 50 stops punching or blocking it. The motorized arm device 26 may include further a means for controlling a speed at which the motorized arm rotates such that the boxing glove 44 could be rotated at a variety of speeds, including a random setting, and so that it could be stopped temporarily when it contacts the person 50.

Figure 8:
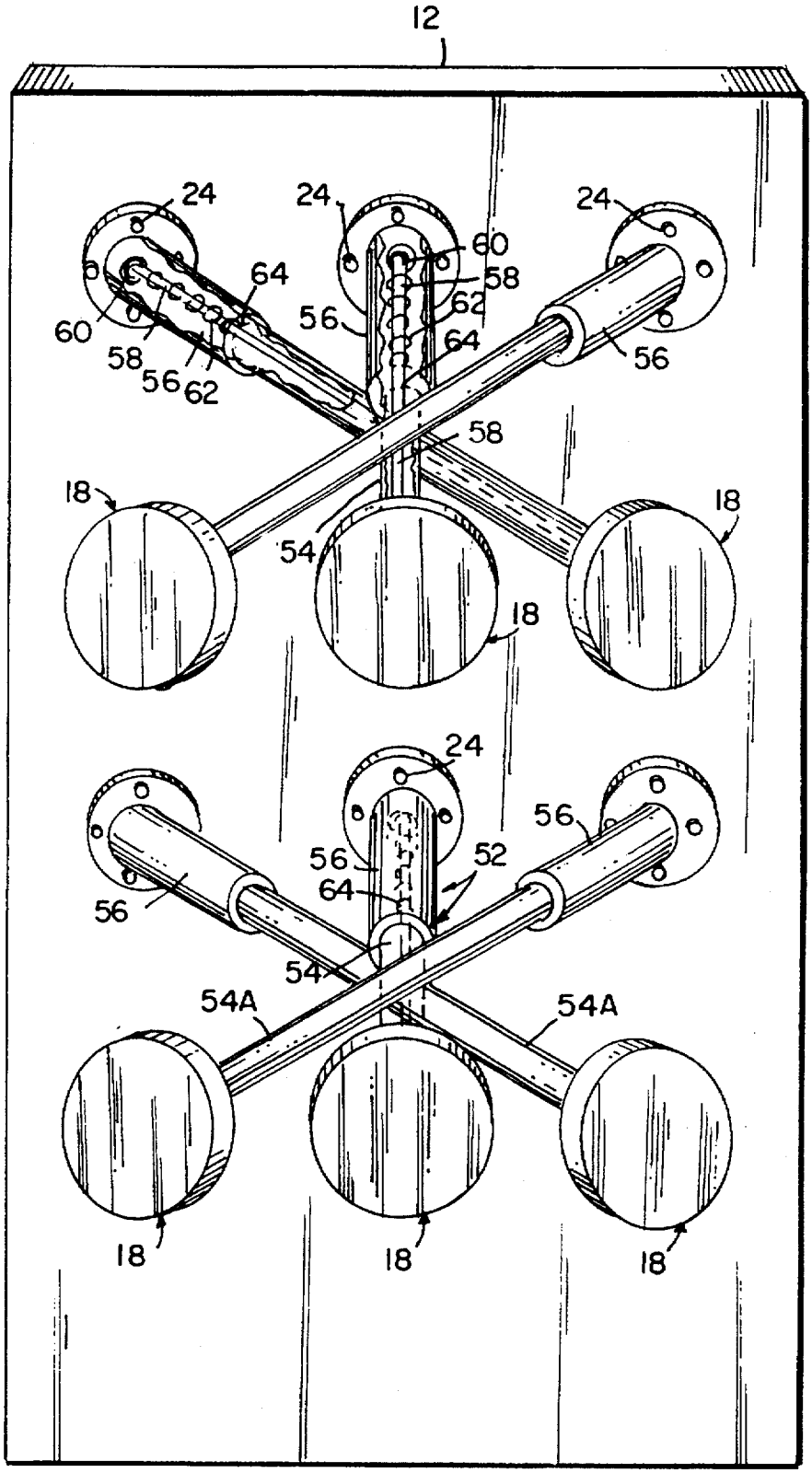
FIG. 8 is an upper view of an alternate embodiment of the attaching devices of the pad devices.

Looking to FIG. 8, another embodiment of the invention depicts the manner in which the round pad devices 18 are attached to the flat board 12. In this embodiment, the middle attaching device 52 is comprised of a inner cover device 54 and a outer cover device 56. Inner cover device 54 is attached to the center pad device 18 and is inserted partly within outer cover device 56 which is attached to nut member 24. Within the cover devices 54 and 56 is a cable 58 that is attached to the nut member 24 and to the center pad device 18 by eyelets 60. Positioned about the cable 58 is a heavy resistance spring material 62 that is attached to an inner section of the nut member 24 and an under section 64 of the inner cover device 54. When the pad device 18 is punched, the pad device 18 resiliently compresses as the inner cover device 54 extends within the outer cover device 56 and then extends back out when the punching hand is removed.

The side pad devices 18 are attached by longer inner cover devices 54 such that they can extend to the left and fight sides of the inner cover device 54 of the center pad device 18. As is indicated, the longer inner cover devices 54, further indicated at 54A, are sufficiently long that one is attached to the left side of the nut member 24 and extends to the right side of the center pad device 18 and the other is attached to the fight side of the nut member 24 and extends to the left side of the center pad device 18. In this embodiment, the left and fight pad devices 18 can be punched in different areas. As is indicated, one long inner cover device 54A passes right above the center inner cover device 54 and the other long inner cover device 54A passes left below the center inner cover device 54.

Figure 9:
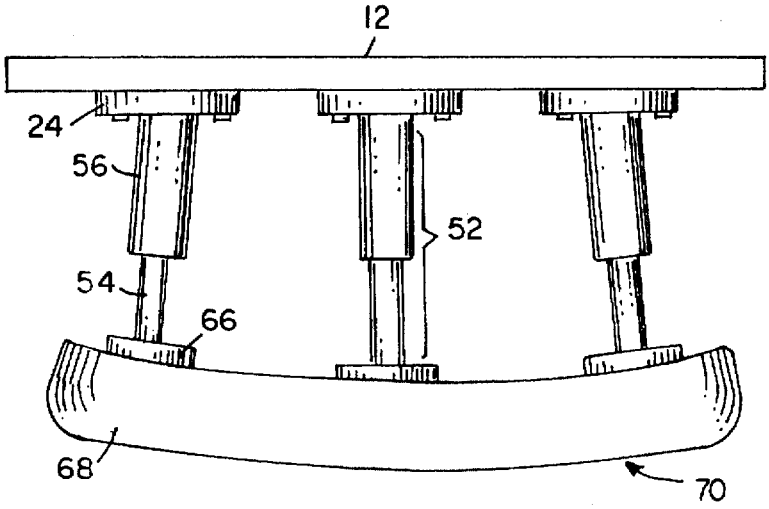
FIGS. 9 and 10 illustrate an alternate embodiment of the punching device of the present invention.
Figure 10:
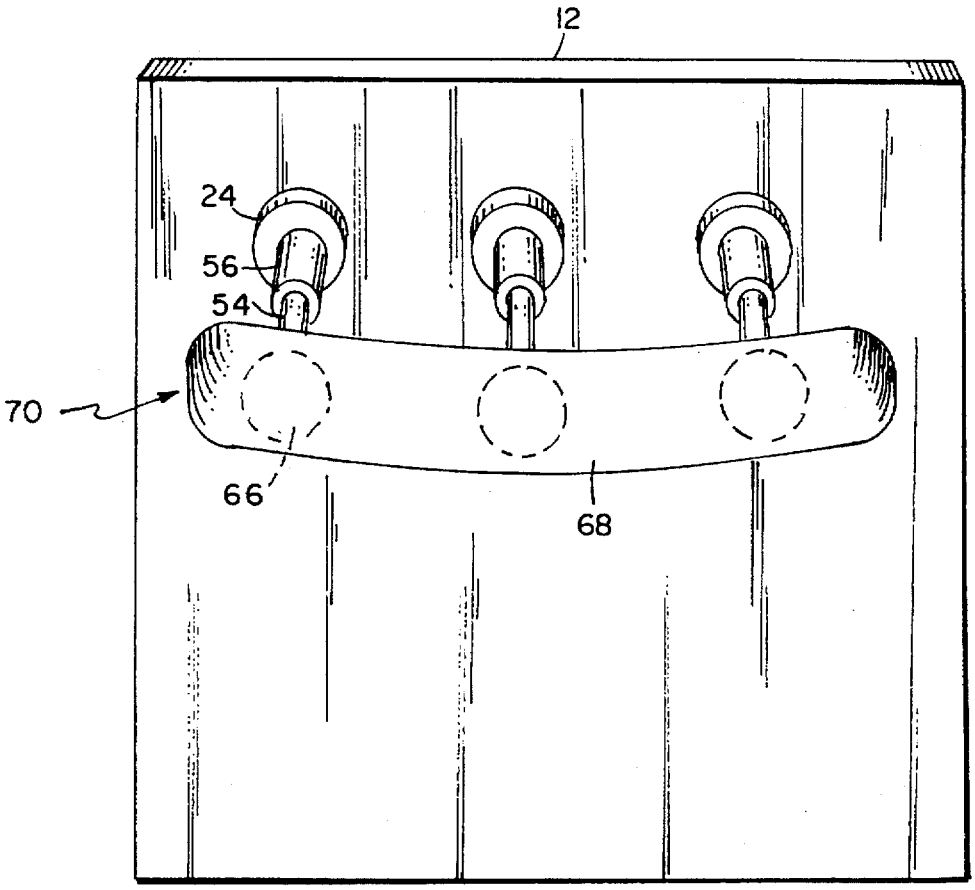

Referring now to FIGS. 9 and 10, there is illustrated an alternative embodiment of the punching device, indicated generally at 70. In this embodiment, each of the inner cover devices 54 are provided with a forward attaching device 66 which is attachable to the single larger pad device 68. In this embodiment, a person 50 is able to punch the pad device 68 at any from position. It is also to be understood that two punching devices 70 can be attached to the flat board 12. Of course, the motorized arm device 26 again would be included.

While the invention has been described with respect to certain preferred embodiments, it will be apparent to those skilled in the art that changes and modifications may be made without departing from the scope of the invention. With this in mind, the following claims are intended to define the scope of protection to be afforded the inventor, and those claims shall be deemed to include equivalent constructions insofar as they do not depart from the spirit and scope of the present invention.

I claim:

1. A punching device assembly for punching practice to sharpen skills of a user in punching while avoiding a component of the punching device, the punching device assembly, in combination comprising comprising:

a first component device positioned generally vertically;

at least one pad device attached to the first component device to be punched by a user;

a second component device with a rotatable motorized arm; and a striking device attached at an outer end of the rotatable motorized arm whereby the striking device rotates into and out of proximity with the at least one pad device and a user is challenged with the combined tasks of striking the at least one pad device assembly while avoiding or preventing being struck by the rotating striking device.

2. The punching device of claim 1 wherein there is a multiplicity of pad devices, wherein at least one pad device is attached to the first component device to form a top group of pad devices, and wherein at least one pad device is attached to the first component device at a distance below the top group of pad devices to form a bottom group of pad devices.

3. The punching device of claim 2 wherein there are six pad devices, wherein the top group of pad devices is comprised of three pad devices that are attached to the first component device in a generally horizontal row and wherein the bottom group of pad devices is comprised of three pad devices that are attached to the first component device in a generally horizontal row; and wherein the first component device comprises a flat board.

4. The punching device of claim 3 wherein each pad de, vice comprises a pad portion attached to an inner cover device that is attached within an outer cover device that is attached to the flat board, wherein the inner cover device of a center pad device of each of the top group of pad devices and the bottom group of pad devices is substantially perpendicular to the flat board, and wherein the inner cover device of each side pad device of each of the top group of pad devices and the bottom group of pad devices is arranged at an angle to the flat board and is of a predetermined length such that the inner cover device of each side pad device extends from one side to the other side of the center pad device of the group of which the side pad device is a member.

5. The punching device of claim 4 wherein the pad portion of the side pad devices of each grouping each are attached to a longer inner cover device wherein the longer inner cover device of one side pad device extends right above the inner cover device of the center pad device and wherein the longer inner cover device of an opposing side pad device extends left below the inner cover device of the center pad device.

6. The punching device of claim 1 wherein the second component device further comprises a means for alternately rotating the striking device in a first direction followed by a second, opposite direction.

7. The punching device of claim 1 wherein the second component device further includes a means for controlling a speed of rotation of the motorized arm.

8. A punching device assembly for punching practice to sharpen skills of a user in punching while avoiding a component of the punching device, the punching device assembly, in combination comprising:

a first component device with an upstanding support and at least one pad device attached to a front portion of the upstanding support to be punched by a user wherein the at least one pad device is comprised of a resiliently-compressible pad portion whereby the at least one pad device resiliently compresses when punched by a user;

a second component device with a rotatable motorized arm, the second component device positioned near the first component device; and a striking device attached to an outer end of the rotatable motorized arm whereby the striking device is rotatable into and out of proximity with the at least one pad device and a user is challenged with the combined tasks of striking the at least one pad device while avoiding or preventing being struck by the rotating striking device.

9. The punching device of claim 8 wherein there is a multiplicity of pad devices, wherein at least one of the multiplicity of pad devices is attached to the upstanding support to form a top group of pad devices, and wherein at least one of the multiplicity of pad devices is attached to the upstanding support at a distance below the top group of pad devices to form a bottom group of pad devices.

10. The punching device of claim 9 wherein there are six pad devices and the upstanding support is comprised of a generally flat board, wherein the top group of pad devices is comprised of three pad devices that are attached to the flat board in a generally horizontal row, and wherein the bottom group of pad devices is comprised of three pad devices that are attached to the flat board in a generally horizontal row.

11. The punching device of claim 10 wherein each pad device is further comprised of an inner cover device and an outer cover device; wherein, in each pad device, the pad portion is attached to the inner cover device, the inner cover device is attached within the outer cover device, and the outer cover device is attached to the flat board; wherein the inner cover device of a center pad device of each of the top group of pad devices and the bottom group of pad devices is attached substantially perpendicular to the flat board; and wherein the inner cover device of each side pad device of each of the top group of pad devices and the bottom group of pad devices is arranged at an angle to the flat board and is of a predetermined length such that the inner cover device of each side pad device extends from one side to the other side of the center pad device of the group of pad devices of which the side pad device is a member.

12. The punching device of claim 11 wherein the pad portion of the side pad devices of each group of pad devices each are attached to a longer inner cover device, wherein the longer inner cover device of one side pad device extends right above the inner cover device of the center pad device, and wherein the longer inner cover device of an opposing side pad device extends left below the inner cover device of the center pad device.

13. The punching device of claim 8 wherein the second component device further comprises a means for alternately rotating the striking device in a first direction followed by a second, opposite direction.

14. The punching device of claim 8 wherein the second component device further includes a means for controlling a speed of rotation of the motorized arm.

* * * * *